US009758178B2

(12) United States Patent
Perry

(10) Patent No.: US 9,758,178 B2
(45) Date of Patent: Sep. 12, 2017

(54) CABLE TROLLEY HAVING A SWIVEL ASSEMBLY AND COUPLING LINK FOR AERIAL SAFETY HARNESS

(71) Applicant: Donald Perry, Branchport, NY (US)

(72) Inventor: Donald Perry, Branchport, NY (US)

( * ) Notice: Subject to any disclaimer, the term of this patent is extended or adjusted under 35 U.S.C. 154(b) by 416 days.

(21) Appl. No.: 14/624,767

(22) Filed: Feb. 18, 2015

(65) Prior Publication Data

US 2015/0232105 A1 Aug. 20, 2015

Related U.S. Application Data

(60) Provisional application No. 61/940,966, filed on Feb. 18, 2014, provisional application No. 61/984,790, filed on Apr. 27, 2014.

(51) Int. Cl.

| | |
|---|---|
| ***B61B 7/00*** | (2006.01) |
| ***B61B 12/02*** | (2006.01) |
| ***A63G 21/22*** | (2006.01) |

(52) U.S. Cl.

CPC ..... *B61B 12/028* (2013.01); *A63G 21/22* (2013.01); *B61B 7/00* (2013.01)

(58) Field of Classification Search

CPC .. B61B 7/00; B61B 7/04; B61B 12/02; B61B 12/028; A63G 21/20; A63G 21/22

See application file for complete search history.

(56) References Cited

U.S. PATENT DOCUMENTS

| | | | | |
|---|---|---|---|---|
| 788,674 | A * | 5/1905 | Riblet | B61B 12/12 104/200 |
| 2,469,069 | A * | 5/1949 | Grazier | A63G 21/20 105/148 |
| 2,471,347 | A * | 5/1949 | Rayburn | B65G 17/485 105/156 |
| 4,246,848 | A * | 1/1981 | Schneider | B61B 12/002 104/173.2 |
| 8,640,626 | B2 * | 2/2014 | Perry | E01B 25/16 104/87 |
| 8,640,627 | B1 * | 2/2014 | Perry | B61B 7/00 104/87 |
| 8,777,819 | B1 * | 7/2014 | Quintana | A63B 69/201 482/83 |
| 2011/0083577 | A1 * | 4/2011 | Tilley | B61B 7/06 104/96 |
| 2013/0042784 | A1 * | 2/2013 | Quattlebaum | B61B 3/02 104/123 |

(Continued)

*Primary Examiner* — Jason C Smith

(74) *Attorney, Agent, or Firm* — Tracy Jong Law Firm; Tracy P. Jong; Cheng Ning Jong

(57) ABSTRACT

An cable trolley comprising a transport structure having a top end and a bottom end, a cable engagement device disposed on the top end, and a swivel assembly disposed on the bottom end, the swivel assembly comprises a central axis of rotation, a support ring having an opening and a central axis of rotation, a sleeve, a retainer disposed on a first end of the sleeve and an adaptor disposed on a second end of the sleeve. The second end of the sleeve is configured to be inserted through the opening until the retainer of the sleeve comes in contact with the support ring and the sleeve is co-axially rotatable relative to the support ring. There is further provided either a carrier for carrying a user or a coupling link attached to the swivel assembly where the coupling link is configured to secure a user with harnessing equipment.

15 Claims, 18 Drawing Sheets

(56) References Cited

U.S. PATENT DOCUMENTS

2014/0360398 A1* 12/2014 Chick ..... B61B 7/00
104/113
2015/0232105 A1* 8/2015 Perry ..... B61B 12/028
105/149.1

* cited by examiner

CABLE TROLLEY HAVING A SWIVEL ASSEMBLY AND COUPLING LINK FOR AERIAL SAFETY HARNESS

PRIORITY CLAIM AND RELATED APPLICATIONS

This non-provisional application claims the benefit of priority from provisional application U.S. Ser. No. 61/940,966 filed on Feb. 18, 2014 and provisional patent application U.S. Ser. No. 61/984,790 filed on Apr. 27, 2014. Each of said applications is incorporated by reference in its entirety.

BACKGROUND OF THE INVENTION

1. The Field of the Invention

The present invention is directed generally to an aerial trolley. More specifically, the present invention is directed to an aerial trolley having a seat that may be orientated using a manual or assisted swivel assembly and an aerial trolley adapted to secure a user already equipped with harnessing devices, e.g., for ziplines.

2. Background Art

Cable trolleys are used mainly for purposes of transportation, sight-seeing and access to elevations not possible with ground vehicles. Recent advancements in material science have caused significant developments in the high speed cable type thrill ride technology, e.g., zipline, roller coasters, etc. The construction of a zipline system is typically minimally invasive to its surroundings. A conventional zipline vehicle is not self-propelled but relies on gravity to traverse lengths of cables. Brakes or mechanisms to slow down the vehicle may be available on a zipline vehicle but the object of zipline is to take advantage of gravity to propel oneself as fast as possible. As a zipline vehicle is used to transport an individual at high speed, it is typically equipped with a harness for securing an individual or a seat that is rotatably (about an axis of a horizontal plane) mounted to the vehicle. A user of a harness equipped zipline vehicle does not have the ability to control the rotation of the user about a vertical axis while a user of a seat equipped zipline does not have the ability to rotate about a vertical axis. In fact, it is undesirable to provide a zipline vehicle having a rotatable seat as a user of the vehicle is required to be orientated in a forward facing manner to anticipate a take-off from or landing at a platform. There is a long-felt and unmet need for an aerial vehicle having a carrier or seat which can be orientated to its user's liking. Trolleys disclosed in Applicant's U.S. Pat. Nos. 8,640,626 and 8,640,627 entitling "Ramp system for bridging flexible cable to rigid rail" and "Traction channel equipped ramp system for bridging flexible cable to rigid rail," respectively, represent the types of vehicles used for traversing cables, ziplines and bridges used to link trees high in a forest canopy. Users interested in gaining a new vantage point on the forest canopy would ride trolleys capable of speeds of up to about 10 mph where speed is not the object and up to grade of about 10 percent.

Conventional trolleys include seats which are incapable of being selectively oriented in a horizontal manner. A user of such trolleys must rotate his/her neck in order to face certain directions. In addition, it may also be impossible to rotate one's neck to face a certain direction, e.g., the rear of the user, especially for a prolonged amount of time. Further, in conjunction with rotating the neck to face a desired direction, such practice may also involve rotating the body. This may cause the weight distribution of the user's body to change unpredictably, making for unstable rides. With the advent of inexpensive point of view (POV) or helmet-mounted cameras, video and recording systems, it is increasingly important to provide trolleys having seats that can be adjusted about a vertical axis to allow for flexible settings of the seat orientation to avoid requiring the user to adjust his point of view to an unnatural direction. Attempts have been made to improve the service life span and comfort of a tram or aerial vehicle. However, none of them discloses an aerial vehicle capable of an orientation adjustable seating.

U.S. Pat. No. 788,674 to Riblet (hereinafter Riblet) discloses a bucket clip for aerial wire-rope tramways. A clip is provided to one end of which the buckets are pivotally connected to swing horizontally in the direction in which the bucket is moving, and which is rigidly connected at its opposite end to the traction-rope, and which is provided with a wrist-pin joint at its central portion arranged to permit the bucket to swing vertically at right angles to the axis of the traction-rope and to the direction in which it is moving above and below the horizontal plane about forty-five degrees. The clip of Riblet is a fatigue-reducing mechanism allowing three dimensional movement of the power cable attachment point. Riblet fails to disclose a mechanism for allowing rotation of the bucket around a vertical axis as provided by the present swivel assembly. The bucket of Riblet remains relatively fixed in place. The support wheels and attachment only allow the bucket to pendulum in the direction of travel. The bucket is pulled along by a power cable that must be allowed to pivot or repeated bending at attachment point 13 of Riblet will fatigue the cable and break it quickly. This pivoting mechanism allows the power cable to pull the bucket without stressing/bending the power cable at its attachment point (13 of Riblet). In Riblet, the bucket is not suspended from the pivot and the bucket supports do not allow the bucket to rotate.

Thus, there arises a need for a cable trolley adapted to secure a harness-donned user and which allows orientation adjustment of the user to his/her liking either manually or via a drive mechanism.

SUMMARY OF THE INVENTION

In one embodiment, the present invention is directed toward a cable trolley having a carrier is capable of being orientated in any direction. The cable trolley includes a transport structure having a top end and a bottom end, a cable engagement device disposed on the top end of the transport structure, and a swivel assembly disposed on the bottom end of the transport structure. The swivel assembly comprises a central axis of rotation, a support ring having an opening and an axis of rotation, a sleeve, a retainer disposed on a first end of the sleeve and an adaptor disposed on a second end of the sleeve. The second end of the sleeve is configured to be inserted through the opening until the retainer of the sleeve comes in contact with the support ring and the sleeve is coaxially rotatable relative to the support ring.

In another embodiment, the present invention is directed toward a cable trolley having a support mechanism capable of being orientated in any direction. The cable trolley includes a transport structure having a top end and a bottom end, a cable engagement device disposed on the top end of the transport structure, and a swivel assembly disposed on the bottom end of the transport structure. The swivel assembly comprises a central axis of rotation, a support ring having an opening and an axis of rotation, a sleeve, a retainer disposed on a first end of the sleeve and an adaptor configured to secure a carabiner that is disposed on a second end of the sleeve. The second end of the sleeve is configured to be inserted through the opening until the retainer of the sleeve comes in contact with the support ring and the sleeve is coaxially rotatable relative to the support ring.

In one embodiment, the present cable trolley further comprises a locking mechanism including a slot adapted to a portion of the retainer and a lock having an axis of rotation that is substantially perpendicular to the central axis of rotation of the swivel assembly, where the lock is attached to the support ring. When the lock is disposed within the slot, rotation of the sleeve relative to the support ring is prevented and when the lock is removed from the slot, rotation of the sleeve relative to the support ring is allowed.

In one embodiment, the present cable trolley further comprises a carrier having a top end and a bottom end where the carrier is adapted, at its top end, to the adaptor.

In one embodiment, the present cable trolley further comprises at least one handle bar fixedly attached to a portion of the transport structure. Each handle bar serves as a grasp point for a user seated in the carrier to apply a torque to rotate the carrier about the central axis of rotation such that the carrier may be orientated to the user's liking. For a trolley equipped with an adaptor for securing a harness, at least one handle bar is provided to also serve as a grasp point for a user secured to the adaptor to apply a torque to cause a change in the orientation of the user with respect to the transport structure.

In one embodiment, the present cable trolley further comprises a rotation mechanism capable of assisting rotation of the sleeve about the central axis of rotation.

In one embodiment, the present cable trolley further comprises a first gear having a central axis of rotation and a second gear operably coupled to the first gear. The first gear is coaxially attached to the sleeve and the second gear is adapted to a motor. The motor is adapted to drive the sleeve in any direction about the central axis of rotation of the sleeve.

In one embodiment, the support ring further comprises a grease port adapted to receive application of grease between the sleeve and the support ring through the grease port.

In one embodiment, the present cable trolley further comprises a washer configured to be disposed between the retainer and the support ring for reducing the friction between the retainer and the support ring, facilitating rotation of the carrier relative to the transport structure.

Accordingly, it is a primary object of the present invention to provide a cable trolley having a carrier which can be orientated in any horizontal orientations relative to the cable trolley's travel direction.

It is a another object of the present invention to provide a cable trolley adapted to secure a harness-equipped user such that the user can orientate himself or herself in any horizontal orientations relative to the cable trolley's travel direction with or without the aid of a motor.

It is another object of the present invention to provide a cable trolley having a carrier which can be orientated in any horizontal orientations relative to the cable trolley's travel direction manually.

It is another object of the present invention to provide a cable trolley having a carrier capable of being orientated in any horizontal orientations with an assist device.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

1—conventional vehicle/trolley
2—cable or aerial vehicle/trolley
4—transport structure
6—swivel assembly
8—support ring
10—L-shaped bracket
12—aperture
14—retainer
16—locking mechanism
18—carrier
20—adaptor
22—washer
24—grease port
26—slot
28—lock
30—pivot of lock
32—sleeve
34—drive mechanism
36—cable
38—seat
40—user
42—handle bar
44—fastener for securing handle bar to transport structure or swivel assembly
46—deviation from forward facing orientation
48—support
50—drive wheel
52—axle
54—frame securing a drive wheel to a trolley
56—motor
58—pinion
60—spur gear
62—back bar of seat
64—platform of seat
66—foot rest of seat
68—central axis of swivel assembly
70—spring
72—cord
74—loop
76—carabiner
78—zipline harness
80—zipline trolley
82—yoke
84—aperture
86—strap
88—battery pack
90—C-shaped tube
92—support frame
94—back of seat
96—motorized swivel assembly

PARTICULAR ADVANTAGES OF THE INVENTION

The present cable trolley provides its user a means to dispose the seat of the cable trolley in an orientation other than the conventional front-facing orientation. In one embodiment, the carrier of a present cable trolley is capable of rotation about a vertical axis, enabling a user to face any horizontal orientation desired. In another embodiment, the seat of a present cable trolley is capable of rotation where the seat is supported using a support frame.

In one embodiment, a washer is disposed between the retainer and the support ring of a swing assembly to provide appropriate friction which decreases the ease with which the sleeve rotates with respect to the support ring but yet makes rotation of the sleeve relative to the support ring easier.

In yet another embodiment, the present cable trolley provides a transport structure capable of low speeds where a user equipped with high speed transport on zipline can be readily secured on the present cable trolley to travel at a low speed. Ziplines are used typically to transport users at high speed. There are however occasions where zipline users may want to experience their surroundings at a more leisurely pace. For zipline users who have already been equipped with necessary zipline equipment, the Applicant discovered a means for transporting such users with simplified trolleys. Although not requiring a carrier, a simplified trolley is still capable of enabling rotation of its one or more users.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
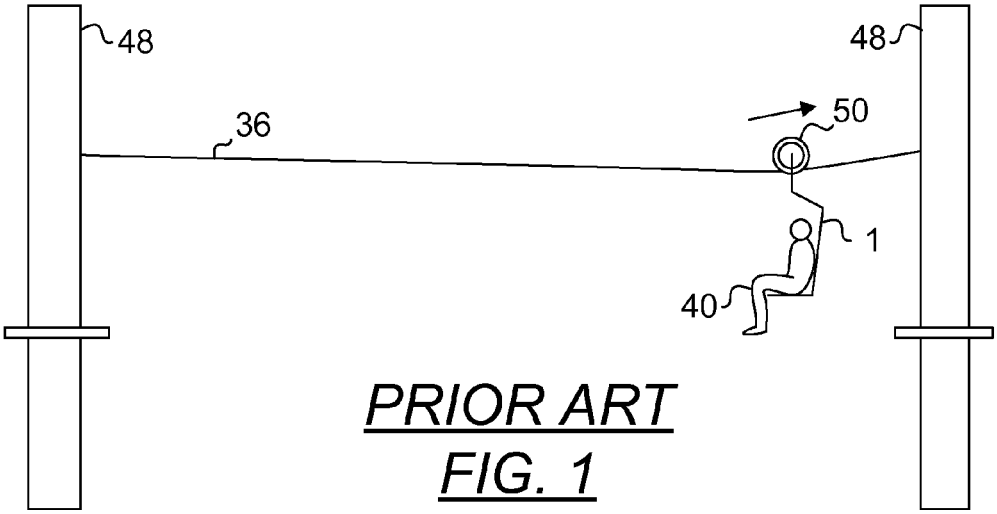
PRIOR ART FIG. 1
FIG. 1 is a diagram depicting the use of a cable trolley on a cable simply supported at its ends using a support on each end.
Figure 2:
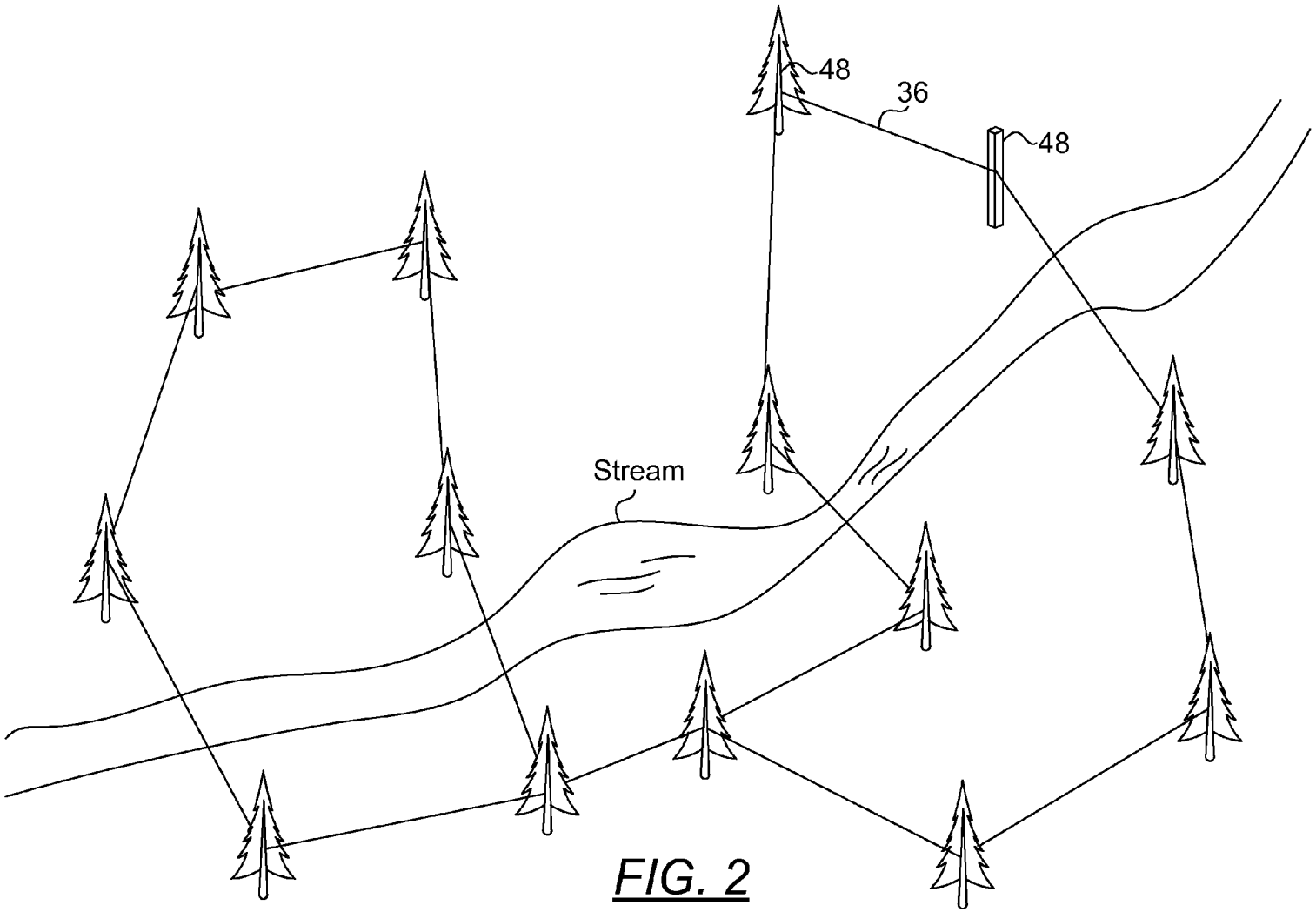
FIG. 2 is a diagram depicting a network of cables connecting various erected structures.

FIG. 1 is a diagram depicting the use of a conventional cable trolley 1 on a cable 36 simply supported at its ends using a support 48 on each end. FIG. 2 is a diagram depicting a network of cables connecting various erected structures (trees and man-made structures). The cable 36 is spanned between two supports 48 and simply supported at each end with a support 48. The cable 36 is configured for use with a trolley 1, 2 having a drive wheel 50 which comes in contact with and rides on the cable 36. On a conventional cable trolley, the seat or device for securing its user is horizontally orientated in the direction of travel as shown in FIG. 1 and incapable of orientation adjustment. A user 40 wishing to look in a direction away from this fixed orientation must do so by adjusting the user's body posture and/or neck, making for awkward, uncomfortable or even unsafe rides due to changes in the user's center of gravity especially while the trolley is on the move. Further, as the present cable trolley is primarily used for aerial travel in sight-seeing trips through an environment, for instance as shown in FIG. 1, the Applicant has discovered the benefits of providing a cable trolley capable of horizontal orientation adjustments without significant potential ill effects such as swaying of the cable trolley while the horizontal orientation of the cable trolley is being adjusted and/or excessive angular displacement of the carrier when the carrier is disposed substantially perpendicularly with respect to the direction of travel.

Figure 3:
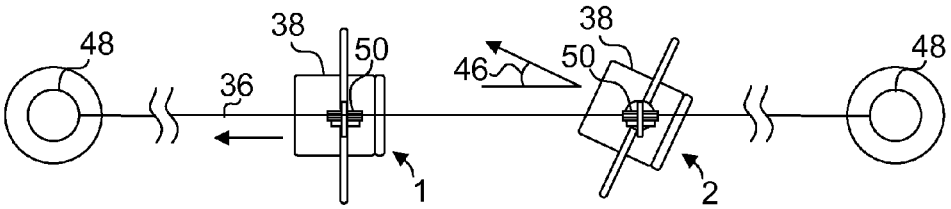
FIG. 3 is a plan view of a cable and trolleys contrasting a fixed orientation cable trolley and a flexible orientation cable trolley.

FIG. 3 is a plan view of a cable and trolleys, contrasting a fixed orientation cable trolley 1 and a flexible orientation cable trolley 2. As trolley 1 travels along cable 36 between the two supports 48, its seat 38 is disposed in a direction parallel to the cable 36, incapable of any other orientations. Trolley 2, on the other hand, is disposed at an angle 46 from the direction of travel along the cable 36. It is this capability of the present cable trolley 2 which sets it apart from the conventional trolley 1.

Figure 4:
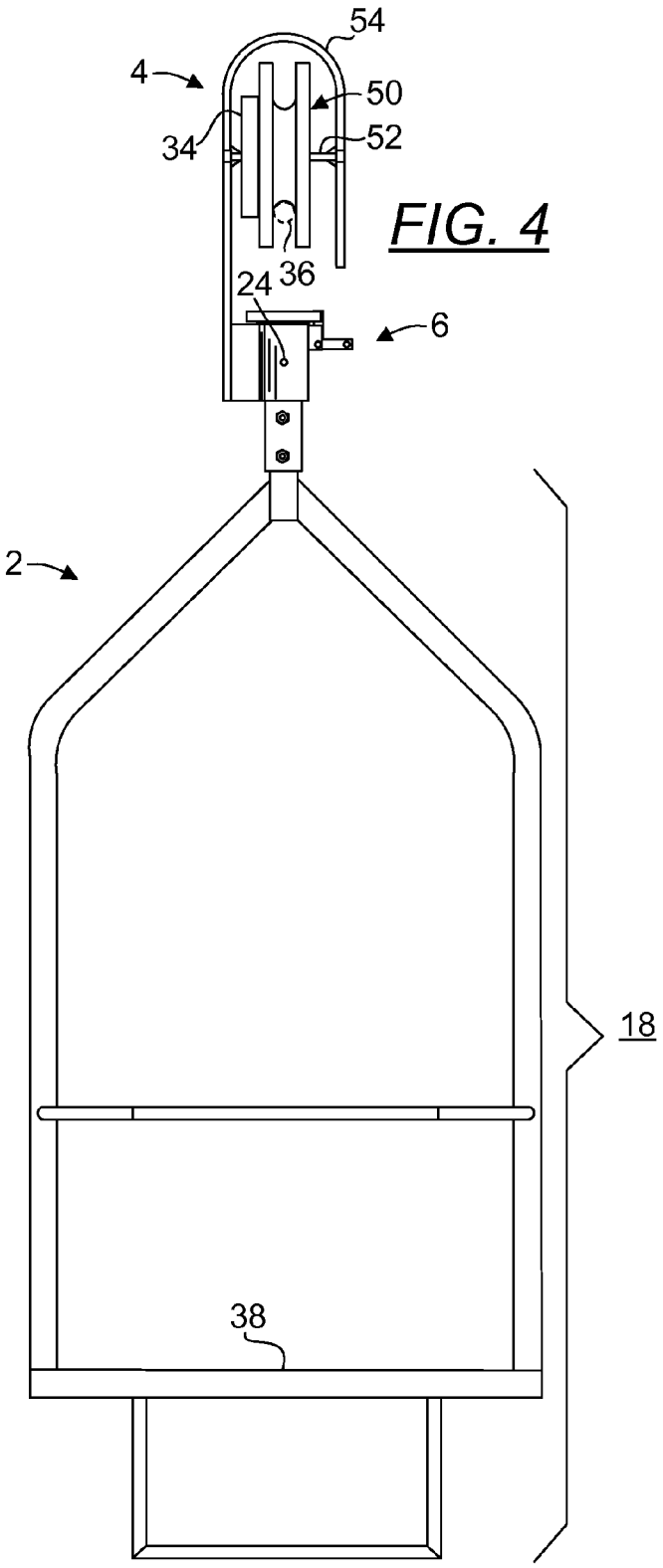
FIG. 4 is a front orthogonal view of one embodiment of the present cable trolley, depicting the carrier of the trolley being disposed in one orientation.
Figure 5:
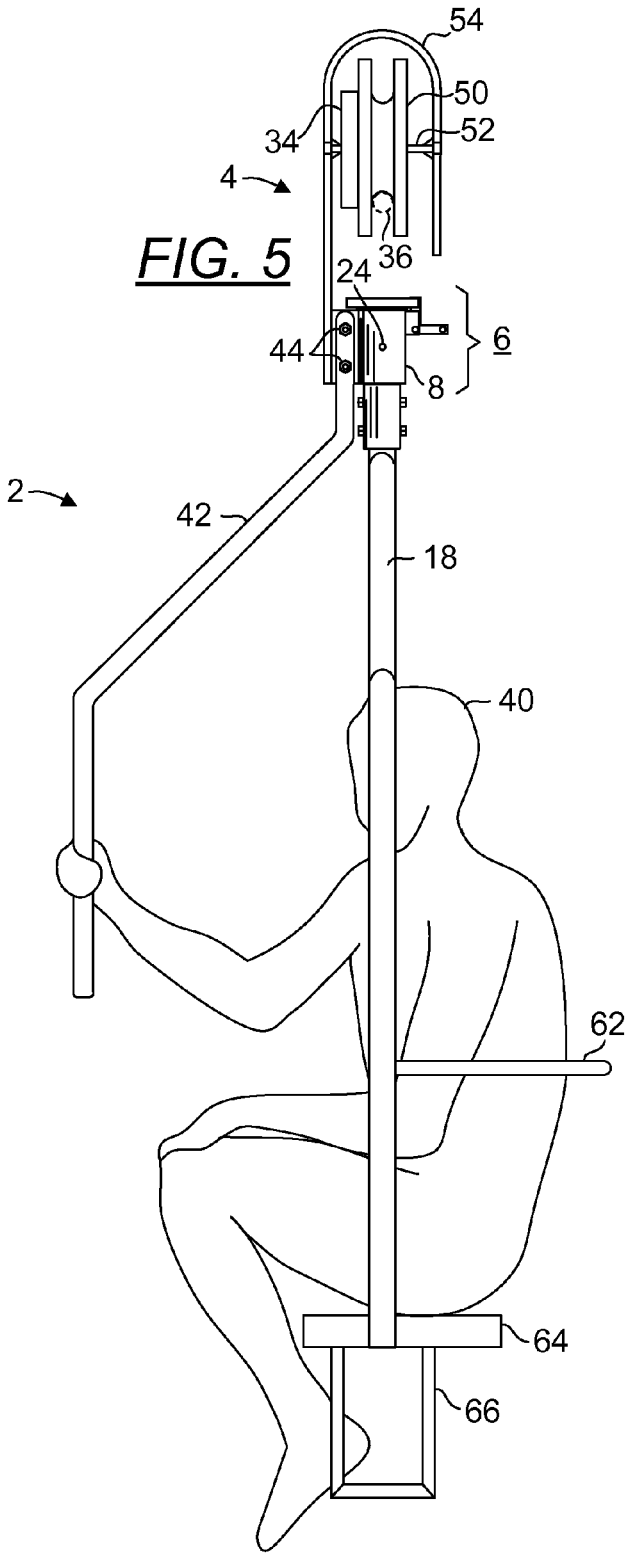
FIG. 5 is a front orthogonal view of one embodiment of the present cable trolley, depicting the carrier of the cable trolley being disposed in another orientation and one embodiment of a handle bar.

FIG. 4 is a front orthogonal view of one embodiment of the present cable trolley, depicting the carrier 18 of the trolley being disposed in one orientation. In this orientation, the carrier 18 is orientated in a direction parallel to the direction of travel of the cable trolley. FIG. 5 is a front orthogonal view of one embodiment of the present cable trolley, depicting the carrier of the trolley being disposed in another orientation where the seat 38 or carrier 18 is disposed at an angle substantially perpendicular to the direction of travel of the trolley 2. In this embodiment, a handle bar 42 is fixedly attached to the support structure 4 or swivel assembly 6 using two fasteners 44. The handle bar 42 serves as a grasp point for a user 40 seated in the carrier to apply a torque to rotate the carrier 18 about the central axis 68 of rotation of the swivel assembly 6. The handle bar 42 is preferably disposed sufficiently close to the user 40 for easy reach but not so close as to be a barrier to the user 40 when rotating the carrier. In one embodiment not shown, at least one additional handle bar 42 is provided as an additional grasping point to facilitate manual rotation of carrier about the central axis of rotation of the swivel assembly 6. It is advantageous that the carrier rotates only when the user applies torque to the handle. Unrestricted rotation would, for example, make nature photography and observation difficult. It is therefore practical to have a retainer-sleeve contact resistance that requires about 5 ft-lbs of torque to rotate the carrier at about 200 lb (including its own weight). Below about 5 ft-lbs, it becomes increasingly likely for unwanted rotation to occur. Above this torque requirement, it becomes increasingly difficult to rotate the carrier.

Figure 6:
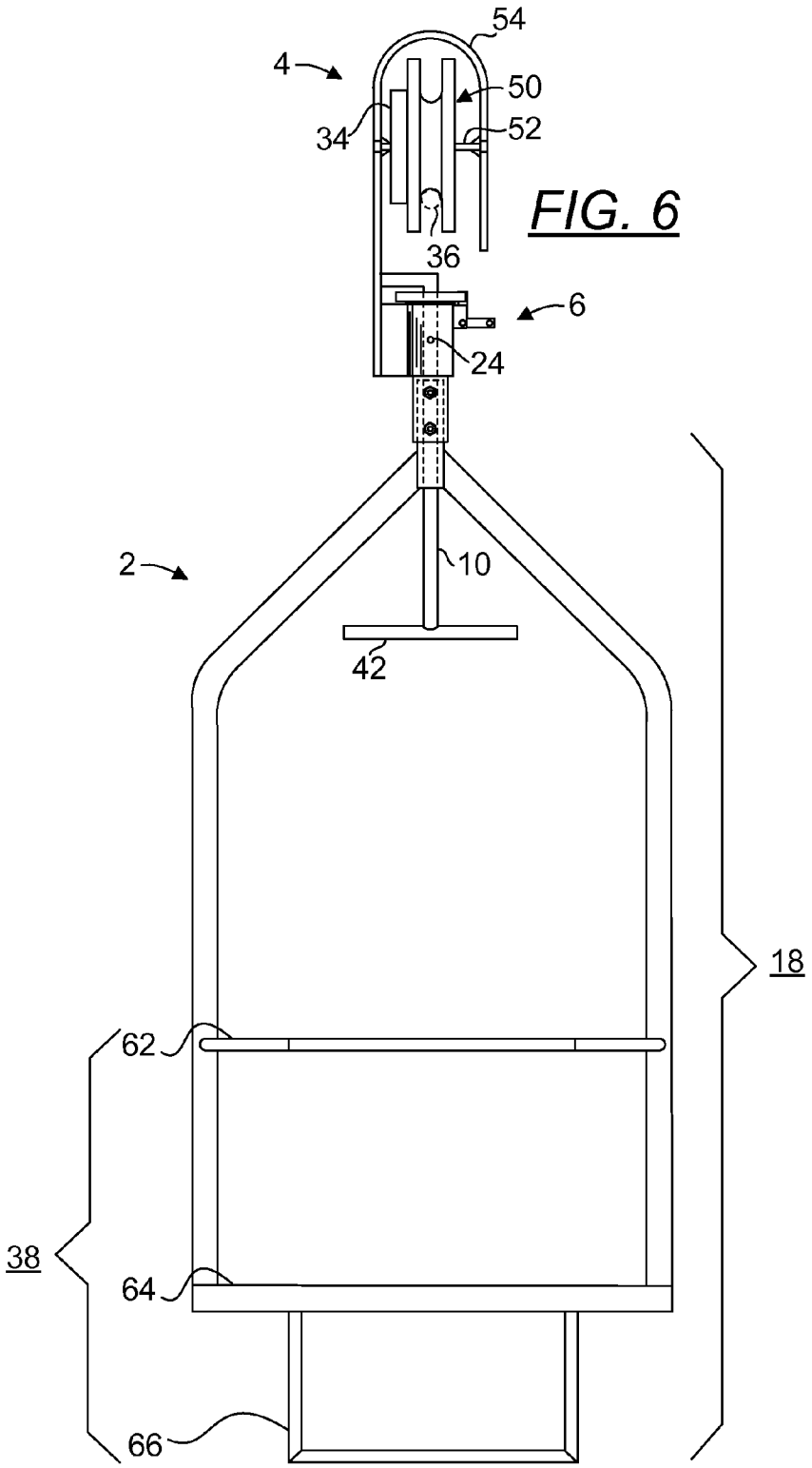
FIG. 6 is a front orthogonal view of one embodiment of the present cable trolley, depicting a second embodiment of a handle bar.

FIG. 6 is a front orthogonal view of one embodiment of the present cable trolley, depicting a second embodiment of a handle bar 42. In this embodiment, an L-shaped bracket 10 having a first end and a second end is used and a hollow construction at the swivel assembly 6 and carrier 18 is used such that the second end of the L-shaped bracket can be inserted through the openings of the swivel assembly 6 and carrier 18 to protrude from the top end of the carrier 18. The first end of the L-shaped bracket is fixedly attached to a portion of the frame 54. A cross bar is then attached to the second end of the L-shaped bracket to form the handle bar 42 shown. Alternatively, a wheel may be instead attached to the second end of the L-shaped bracket to form enhanced grasp points when a user 40 is seated in any orientations.

Figure 7:
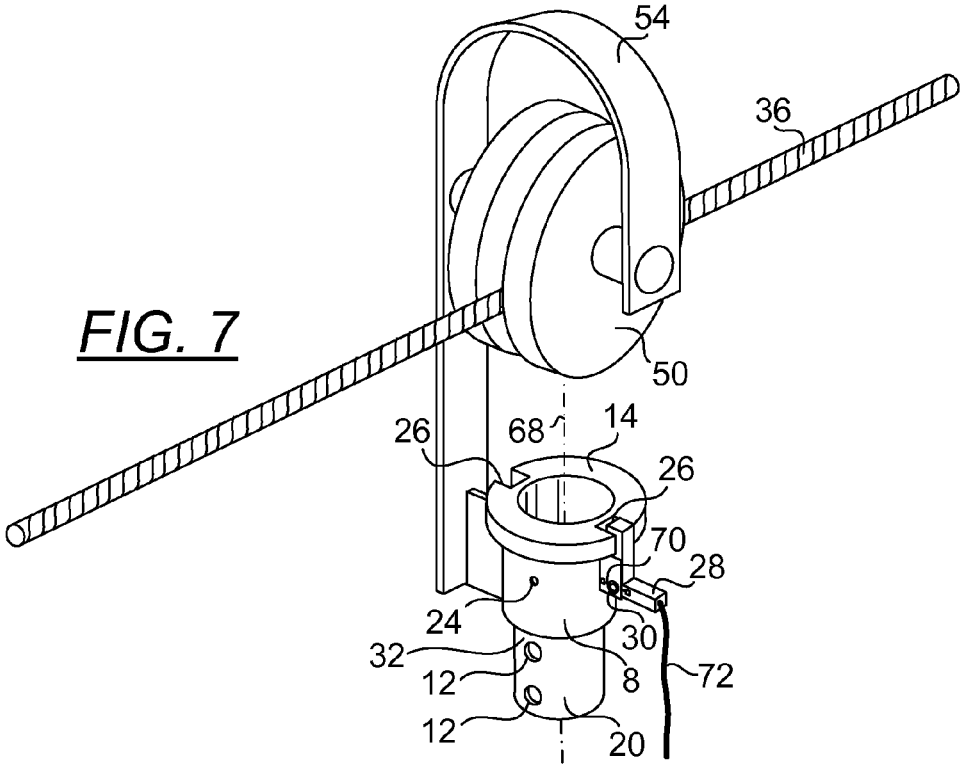
FIG. 7 is a top perspective view of one embodiment of the present swivel assembly, depicting a locking mechanism in the locked position.
Figure 8:
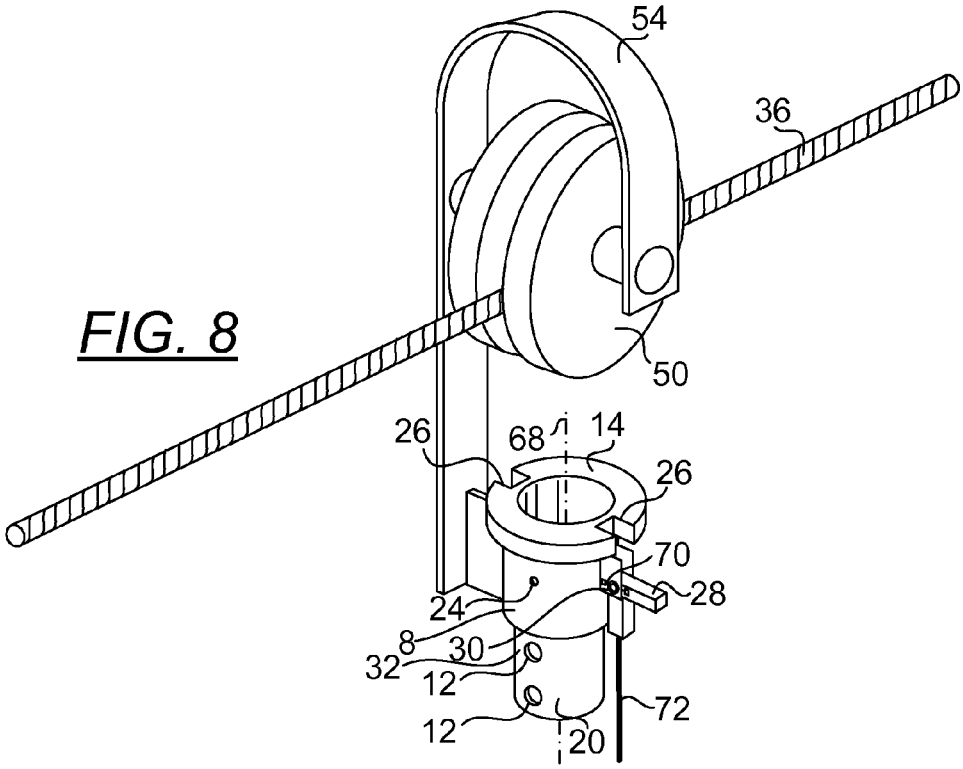
FIG. 8 is a top perspective view of one embodiment of the present swivel assembly, depicting a locking mechanism in the unlocked position.
Figure 9:
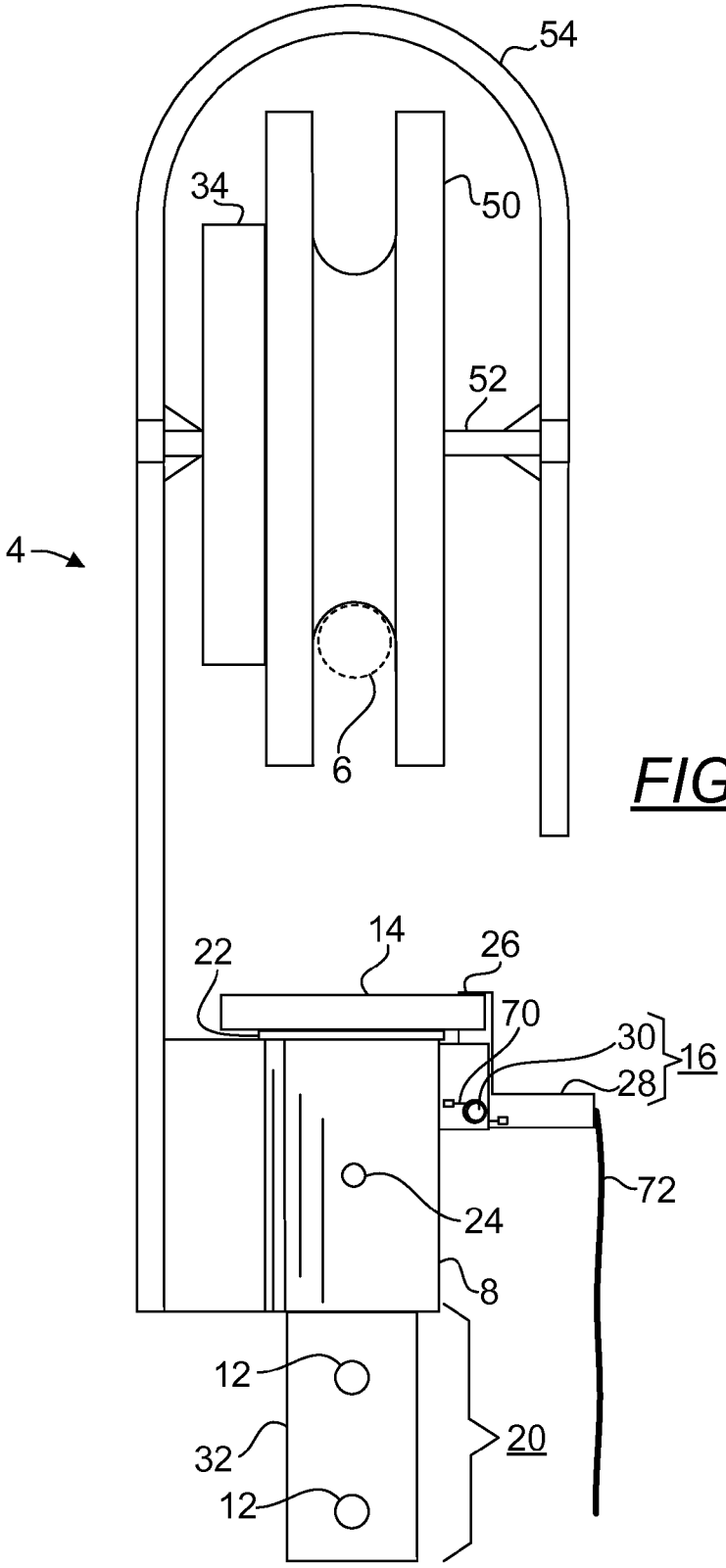
FIG. 9 is a front orthogonal view of one embodiment of the present swivel assembly.
Figure 10:
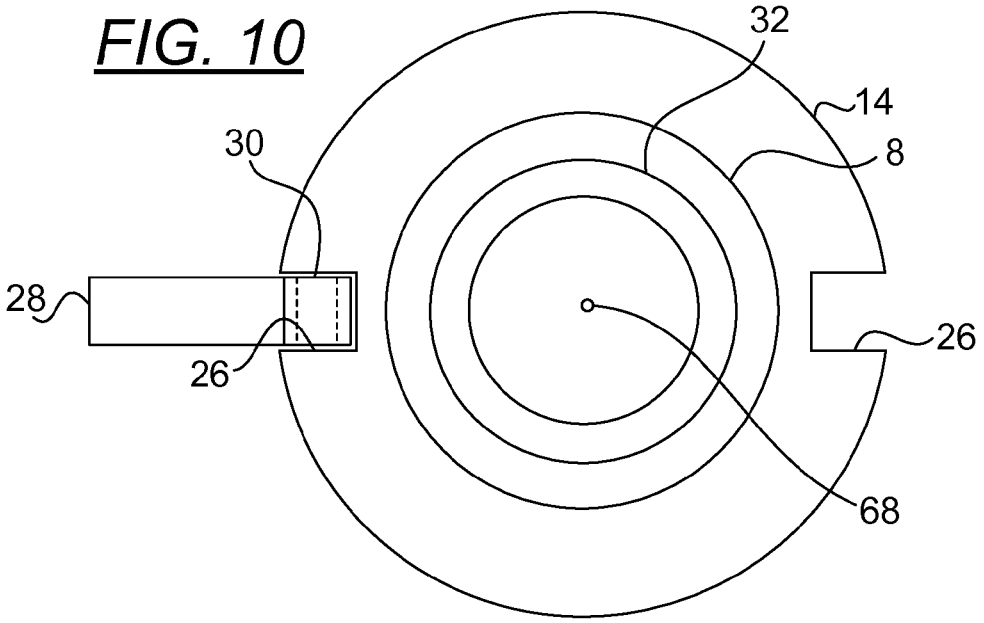
FIG. 10 is a partially transparent top view of one embodiment of the present cable trolley, depicting the locked state of the present locking mechanism.

FIG. 7 is a top perspective view of one embodiment of the present swivel assembly, depicting the locking mechanism in a locked position. FIG. 8 is a top perspective view of one embodiment of the present swivel assembly, depicting the locking mechanism in an unlocked position. FIG. 9 is a front orthogonal view of one embodiment of the present swivel assembly. FIG. 10 is a partially transparent top view of one embodiment of the present cable trolley, depicting one state of the present locking mechanism. The present cable trolley 2 includes a frame 54 having a top end and a bottom end, a cable engagement device disposed on the top end, and a swivel assembly 6 disposed on the bottom end, the swivel assembly 6 comprises a central axis of rotation 68, a support ring 8 having an opening, a sleeve 32, a retainer 14 disposed on a first end of the sleeve 32 and an adaptor 20 disposed on a second end of the sleeve 32. The support ring 8 is preferably a cylindrical housing within which the sleeve 32, also configured cylindrically, is disposed. In the embodiment shown, the adaptor 20 includes one or more apertures 12 for receiving fasteners 44 used to connect a carrier 18 to the adaptor 20. The top end of the carrier 18 preferably includes matching apertures through which fasteners 44 may be inserted and tubing of similar construction to the adaptor 20 to secure the carrier 18 to the adaptor 20. The bottom end of the sleeve 32 is configured to be inserted through the opening of the support ring 8 until the retainer 14 of the sleeve 32 comes in contact with the support ring 8 and the sleeve 32 is coaxially rotatable relative to the support ring 8. In one embodiment, the transport structure is essentially a thin plate or tubing bent to a shape suitable for holding an axle 52 about which a drive wheel 50 which is driven by a drive mechanism 34 is mounted. A drive mechanism 34 may include, but not limited to, a motor, suitable transmission, chain, brake, etc. In another embodiment, the transport structure is formed from carbon fiber tubing.

In one embodiment, the support ring 8 further includes a grease port 24 adapted to receive application of grease in a space defined by the sleeve 32 and support ring 8 through the grease port 24. Applied grease reduces damages due to friction between the two parts and prolongs the lifespan of such parts. If necessary, a constant supply of grease may be made possible by connecting the port 24 to a supply of gravity fed or manually actuated (e.g., with bottle squeeze, etc.) supply of grease.

Figure 10A:
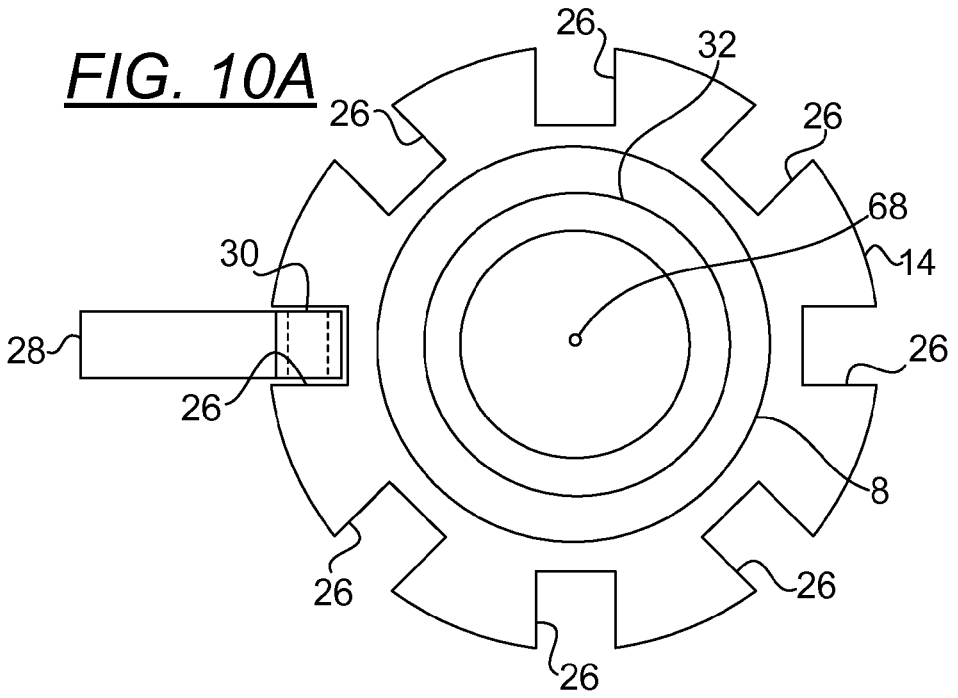
FIG. 10A is a partially transparent top view of one embodiment of the present cable trolley, depicting a retainer having multiple slots.

In one embodiment, a locking mechanism is made available to ensure that the orientation of sleeve 32 relative to the support ring 8 can be fixed. In one embodiment, the locking mechanism includes at least one slot 26 adapted to a portion of the retainer 14 to selectively receive a lock 28 that is pivotably secured at pivot 30 to the support ring 8. When the lock is disposed within the slot 26, rotation of the sleeve 32 relative to the support ring 8 is prevented and when the lock is removed from the slot 26, rotation of the sleeve 32 relative to the support ring 8 is allowed. A torsion spring 70 is adapted to press against the lock 28 such that it tends to return the lock 28 to its locked position. A cord 72 attached to one end of the lock 28 enables easy grasp of lock 28 such that when the cord 72 is pulled towards the user 40, the lock 28 is rotated about pivot 30 to clear the slot 26 within which the lock 28 has been previously been seated, allowing the retainer 14 to be rotated with respect to the support ring 8. Preferably multiple slots 26 are disposed about the central axis of rotation 68 of the swivel assembly, on the retainer 14 such that the user can more readily find a desired orientation to be locked as shown in FIG. 10A. In one embodiment, the present cable trolley 2 further includes a washer 22 disposed between the retainer 14 and the support ring 8 for reducing friction between the retainer 14 and the support ring 8. The Applicant discovered that by using a washer 22 instead of a ball bearing, the rate at which a carrier 18 rotates with respect to the support ring 8 is suitable for user 40 as there is sufficient friction to prevent free-wheeling of the carrier, making it easier for the user to stop at and retain an orientation without using a lock. In another embodiment, bearing races are preferable when a rotation assist device is employed. Such a device exerts appropriate internal friction to cause the carrier to stop at a given orientation. In another embodiment, no washer 22 is provided. Suitable lubricant is instead used to coat contacting portions of the retainer 14 and the support ring 8 to facilitate relative rotation and reduce wear of these parts.

Figure 11:
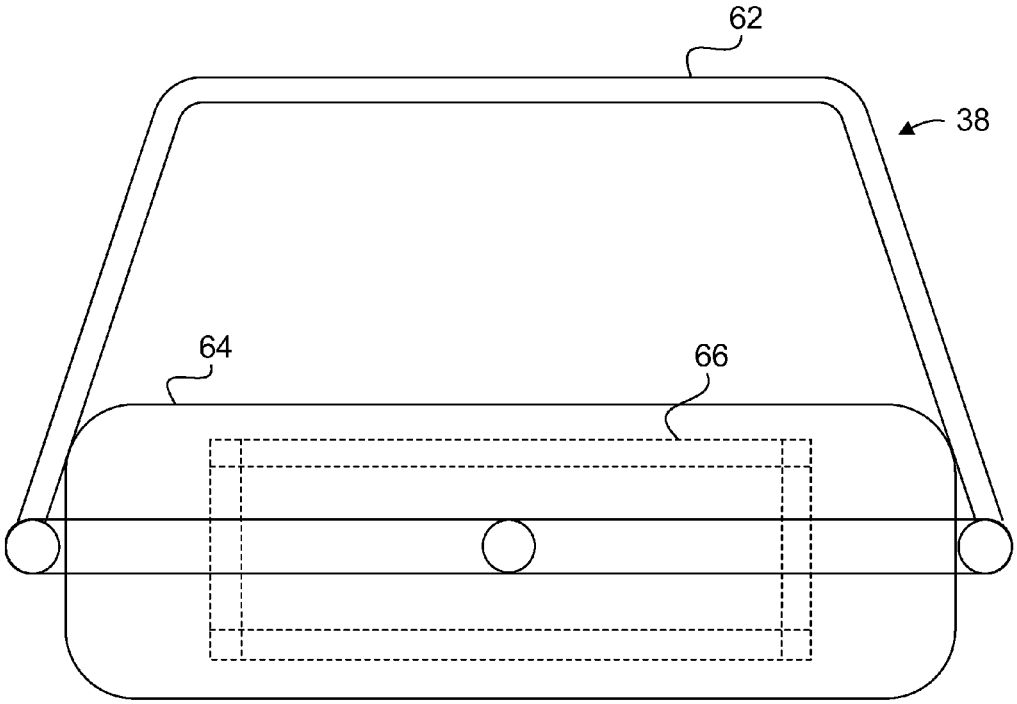
FIG. 11 is a partially transparent top view of one embodiment of the present seat.

FIG. 11 is a partially transparent top view of one embodiment of the present seat 38. Referring to FIGS. 6 and 11, a platform 64 serves as a surface upon which a user 40 can sit. A foot rest 66 is provided to aid a user 40 in exiting the seat by placing the foot rest 66 within reach to the user's legs. A back bar 62 is provided to support and restrain the user from falling as he or she leans back.

Figure 12:
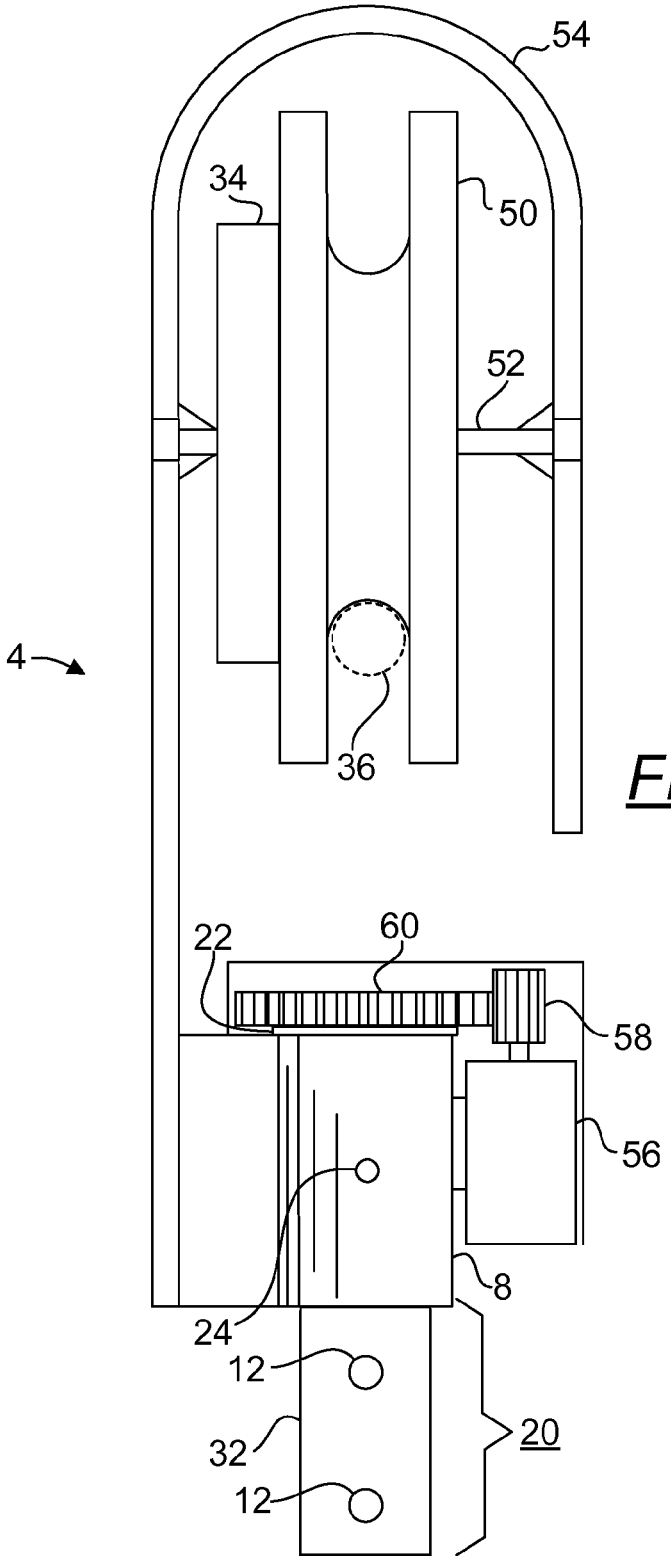
FIG. 12 is a front orthogonal view of another embodiment of the present swivel assembly, depicting a mechanism for causing rotation of an adaptor to which a carrier of the present trolley is secured.

FIG. 12 is a front orthogonal view of another embodiment of the present swivel assembly, depicting a mechanism for causing rotation of an adaptor 20 to which a carrier 18 of the present trolley is secured. Instead of relying on a handle bar 42, a user of this mechanism simply controls the actuation of a motor 56 in a desired direction to rotate the adaptor 20 to dispose it in a desired orientation. In one example, in order to effect rotation, a first gear 60 having a central axis of rotation is coaxially attached to the sleeve 32. The first gear 60 may be attached to a retainer 14 or the first gear 60 may itself be used as a retainer as shown in FIG. 12. The first gear 60 is operably coupled to a second gear 58 adapted to the motor 56 having a sufficient holding torque. In one embodiment, a ball bearing is used in place of a washer disposed between the retainer/first gear and the support ring to reduce friction between such parts as the resistance required to hold the first gear 60 in place is now provided by the second gear 58. In one embodiment, a power source, such as a battery pack used to power the motor and a controller operably connected to the motor, may be disposed at the foot rest 66 to ensure that the center of gravity of the trolley 2 and the user 40 is disposed as low to the ground as possible for stability. The motor 56 may be controlled with a controller disposed at a convenient location at the carrier. Such controller may be wirelessly operably connected to the motor 56. In one example, the drive mechanism 34 and swivel motor 56 are controlled using a single joystick adapted to suitable number of control channels. As a user can control the horizontal orientation and the travel speed of the carrier precisely while driving by subjects in the environment, the resulting precision can be useful for videography.

Figure 13:
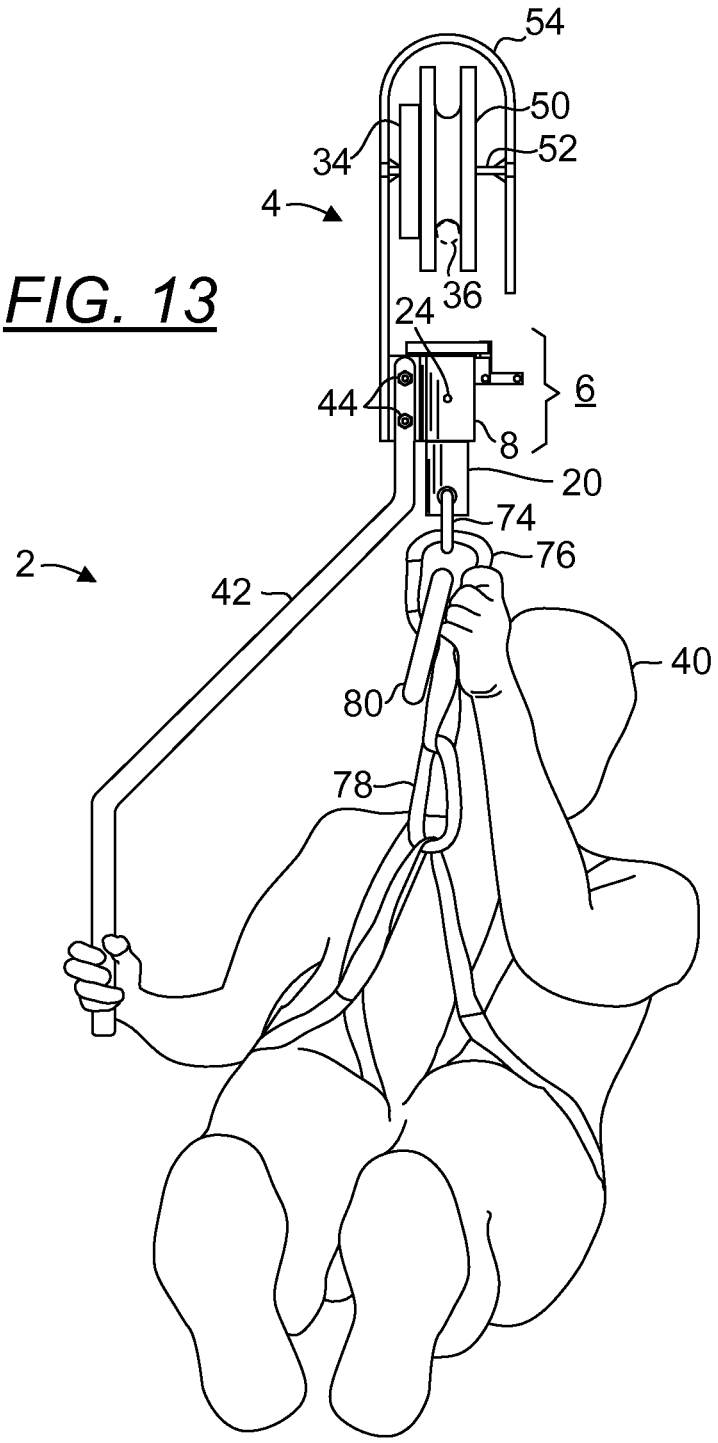
FIG. 13 is a front orthogonal view of one embodiment of the present trolley without a carrier but instead a loop is provided such that a user already equipped with a zipline harness may readily ride the trolley.

FIG. 13 is a front orthogonal view of one embodiment of the present trolley without a carrier but instead a loop is provided such that a user already equipped with a zipline harness may readily ride the trolley. In this embodiment, a loop 74 pivotably attached to the adaptor 20 is provided such that a user may removably connect his or her zipline harness 78 to the trolley via a quick-coupling link, e.g., carabiner 76, that is already a part of the zipline harness 78. For zipline users who have already been equipped with necessary zipline equipment, Applicant discovered that this embodiment is suitable for transporting a user with a present trolley without extraneous parts, i.e., a carrier and necessary hardware for securing the carrier to the adaptor 20. This embodiment is also suitable for any users already equipped with any suitable aerial safety harnesses. A zipline harness 78 typically includes an integrally assembled zipline trolley 80 is still attached to harness 78 upon its detachment from a zipline. Even with the zipline trolley 80 still attached to the harness, it does not present a barrier for attaching the harness 78 to the adaptor 20 as the zipline trolley 80 simply hangs from any part (in this case, the carabiner 76) of the harness 78.

Figure 14:
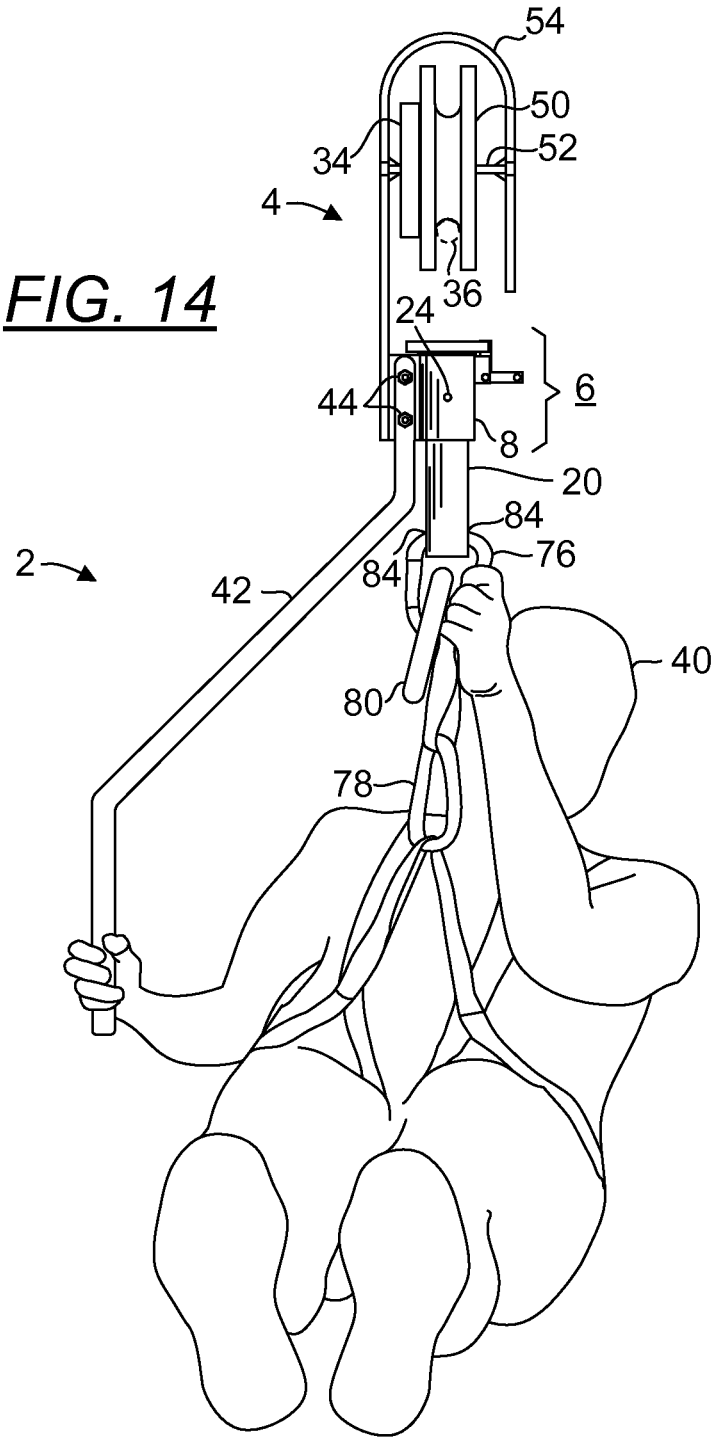
FIG. 14 is a front orthogonal view of one embodiment of the present trolley without a carrier but instead apertures are provided in the adaptor such that a user already equipped with a zipline harness may readily ride the trolley.

FIG. 14 is a front orthogonal view of one embodiment of the present trolley without a carrier but instead apertures are provided in the adaptor such that a user already equipped with a zipline harness may readily ride the trolley. In this embodiment, instead of using a loop 74 to which a carabiner can be secured, one or more apertures 84 are provided in the adaptor 20 such that a carabiner can be attached directly to the adaptor 20 through the one or more apertures 84.

Figure 15:
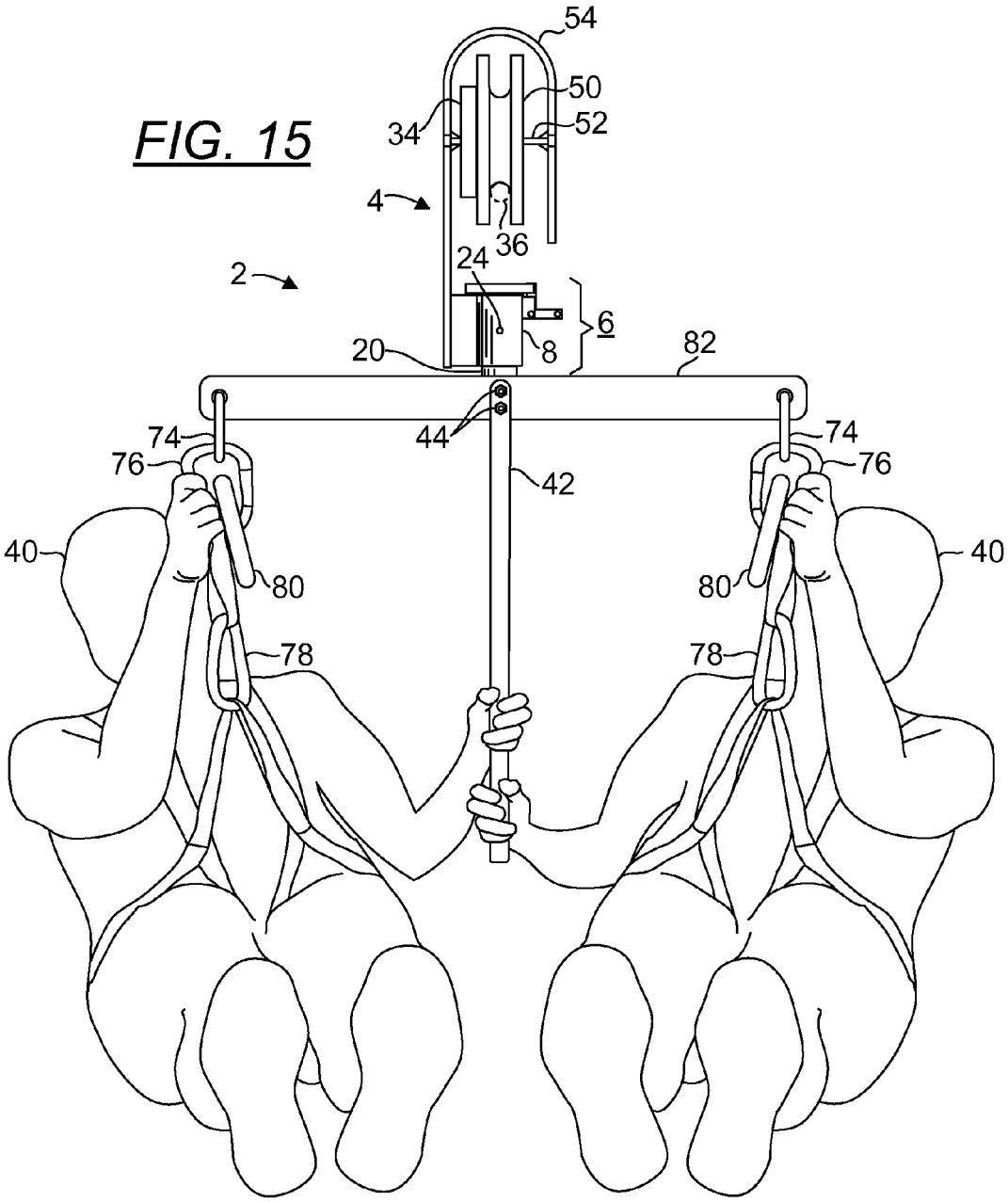
FIG. 15 is a front orthogonal view of another embodiment of the present trolley without a carrier but instead a plurality of loops are provided on a centrally mounted yoke such that users already equipped with zipline harnesses may readily ride the trolley.

FIG. 15 is a front orthogonal view of another embodiment of the present trolley without a carrier but instead a plurality of loops are provided on a centrally mounted yoke such that users already equipped with zipline harnesses may readily ride the trolley. This embodiment is similar to the embodiment disclosed in FIG. 13, with the exception that there are now two loops 74 instead of one. Each loop 74 is pivotably attached to one end of a yoke 82 that is in turn fixedly attached to the adaptor 20. A handle bar 42 secured to the yoke with fasteners 44 extends from a portion of the yoke 82 to provide hand grips to the users 40. This embodiment enables transport of two users 40 at once and cuts down on travel time for a group of users 40. In addition, traveling together on a single trolley can make the travel more enjoyable and increase collaboration between the two users 40. Instead of using loops 74, an aperture may be provided at each end of the yoke 82 such that a quick-coupling link, e.g., carabiner, may be used.

Figure 16:
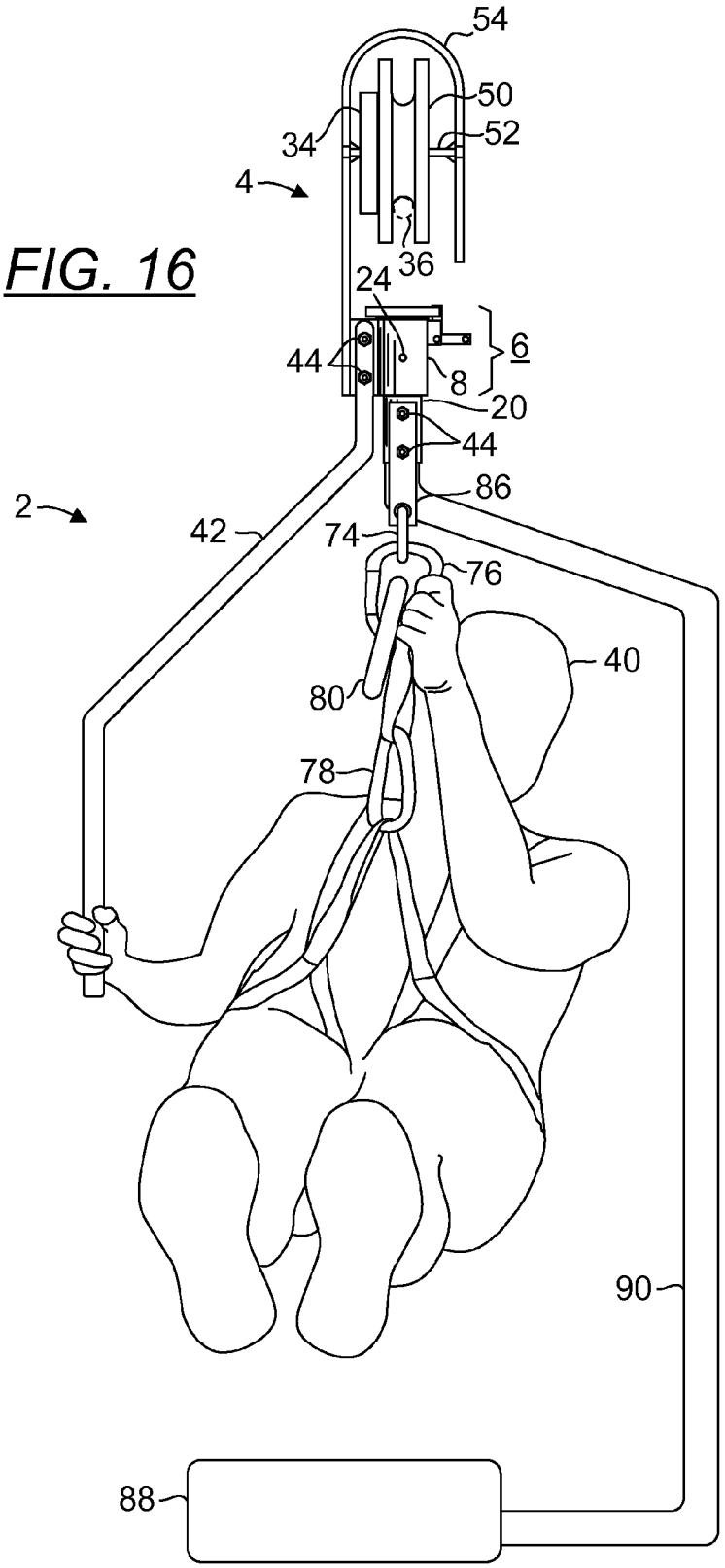
FIG. 16 is a front orthogonal view of another embodiment of the present trolley without a carrier but instead a loop adapted to a strap which is in turn secured to an adaptor of the trolley and a battery pack disposed at the bottom of the trolley and supported by a C-shaped tube attached to the same adaptor.

In another embodiment as shown in FIG. 16, a battery pack is disposed on the bottom end of a tube, constructed from, e.g., steel, bent into the shape of a letter "C." Referring back to FIGS. 13-16, if a powered rotation mechanism is used, e.g., one disclosed in FIG. 12, a power source, such as a battery pack used to power the motor and a controller operably connected to the motor, may be disposed on a portion of the transport structure, swivel assembly or a structure extending from the swivel assembly, in a manner to ensure that the center of gravity of the trolley 2 and the user 40 is disposed as low to the ground as possible and the transport structure is not biased laterally when no users are supported. In one embodiment, a powered rotation mechanism includes a motor operably coupled with the swivel assembly. Referring to FIG. 16, the upper portion of the C-shaped tube 90 is configured for insertion into the adaptor 20 and secured using fasteners 44. A strap 86 is provided, onto which a loop 74 is secured. The same fasteners 44 are used to secure the strap 86 to the adaptor 20. As the battery pack 88 is disposed at an elevation lower than the user 40, the potential for injury of the user 40 due to accidental leakage of caustic and flammable materials of the battery pack 88 is mitigated. The battery pack 88 doubles as a foot rest or platform for stepping onto or off from the trolley.

Figure 17:
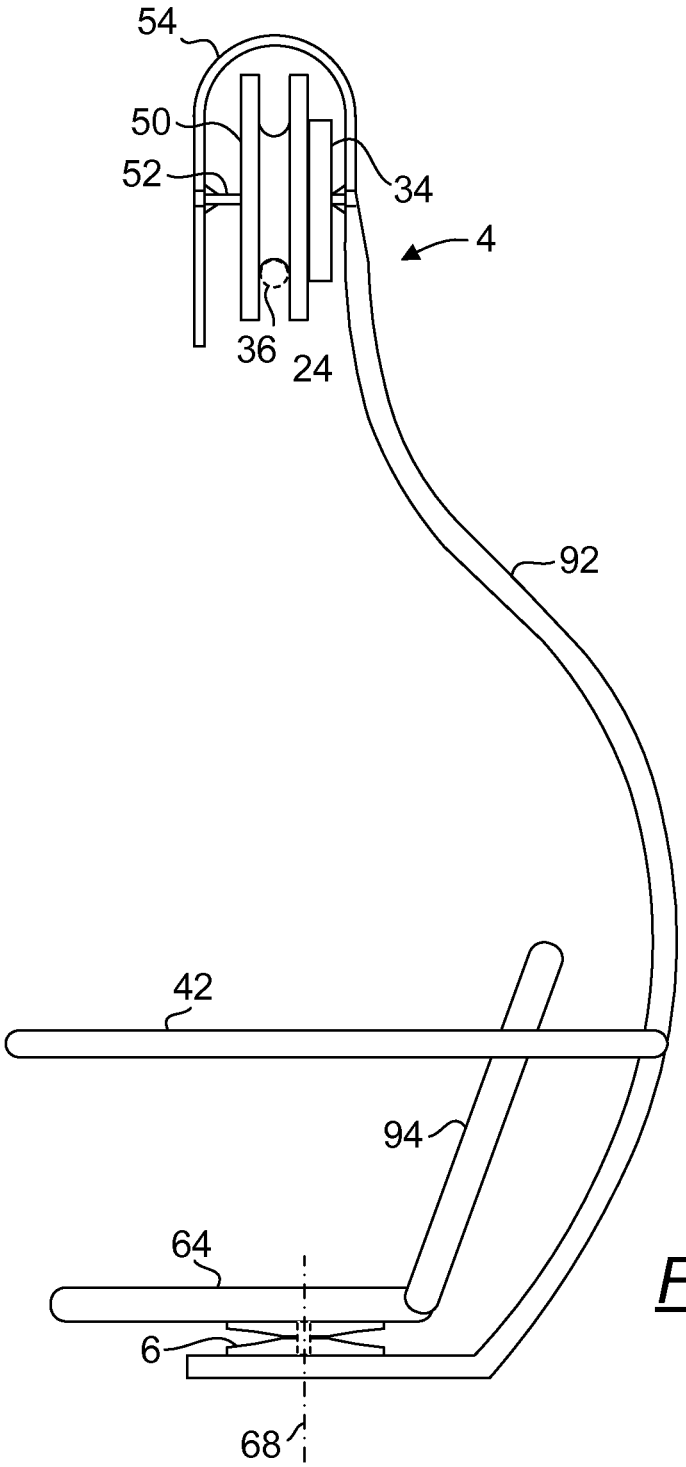
FIG. 17 is a side orthogonal view of yet another embodiment of the present trolley where the swivel assembly is provided in the form of a swivel seat.
Figure 18:
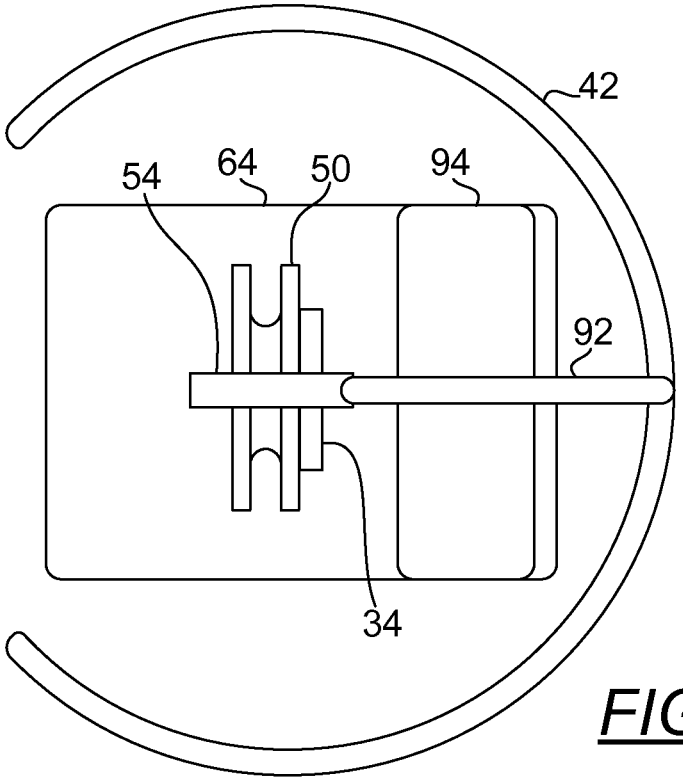
FIG. 18 is a top orthogonal view of the embodiment shown in FIG. 17.

FIG. 17 is a side orthogonal view of yet another embodiment of the present trolley where the swivel assembly is provided in the form of a swivel seat. FIG. 18 is a top orthogonal view of the embodiment shown in FIG. 17. It shall be noted that the swivel assembly 6 is secured at its bottom end to the bottom end of a support frame 92 and at its top end to the bottom of the platform 64 of a seat. The support frame 92 is shaped to accommodate a user while seated in the seat. The swivel assembly 6 may be a conventional swivel chair swivel assembly, i.e., two securing plates, each pressed and stamped or otherwise formed to appropriate shape and strength and the two securing plates are secured with a pin, rivet, bolt or screw at the axis of rotation of the swivel assembly which is also the axis of rotation of each of the securing plates. In this embodiment, the handle bars 42 come in the form of portions of a ring surrounding the platform 64 of the seat. Unlike the embodiments disclosed elsewhere herein, this embodiment does not allow continuous rotation of the seat while a user is seated as the support frame 92 presents a barrier for such rotation.

Although the support frame 92 may be configured, e.g., by distancing the frame from the user's legs, such that full rotation of the seat is enabled, doing so would necessitate a trolley having a much larger footprint which increases the opportunity for entanglement of the trolley in its travel path.

Figure 19:
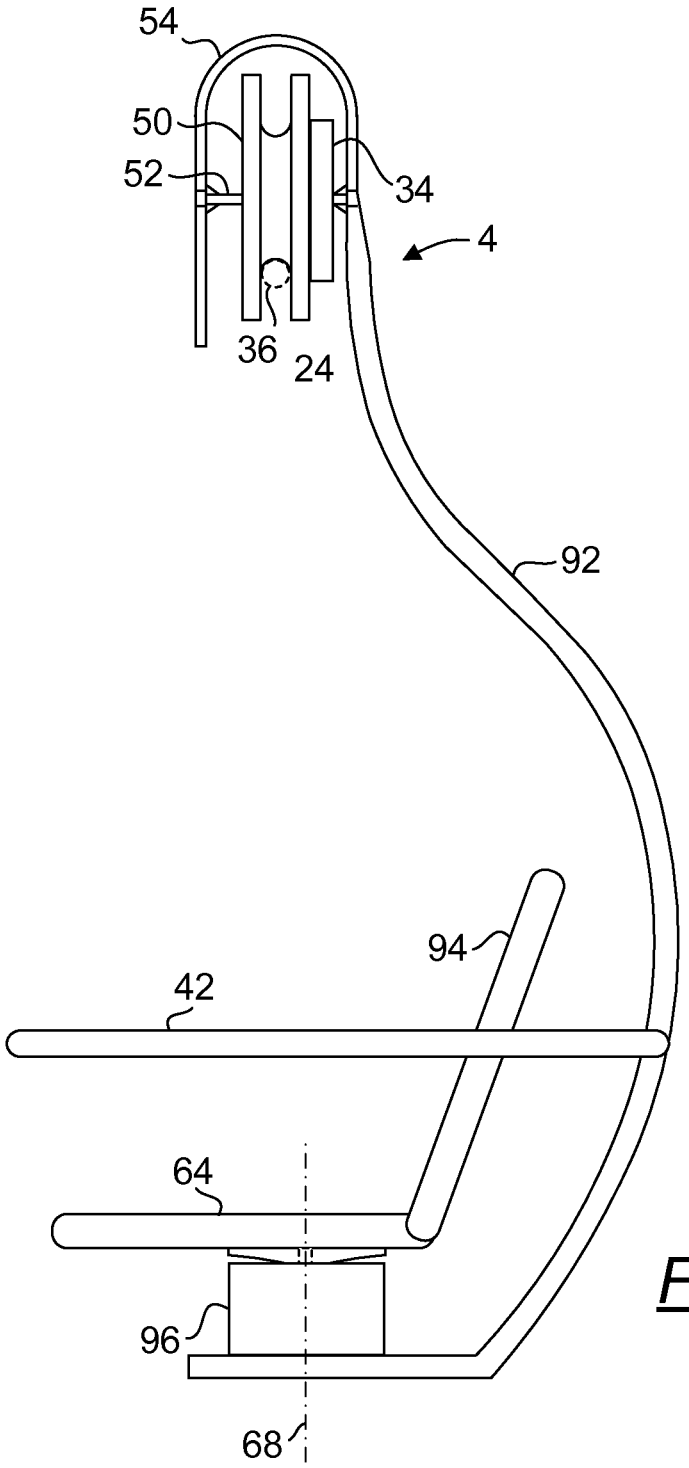
FIG. 19 is a side orthogonal view of the embodiment shown in FIG. 17 with the exception the swivel assembly is replaced with a motorized swivel assembly.

FIG. 19 is a side orthogonal view of the embodiment shown in FIG. 17 with the exception the swivel assembly is replaced with a motorized swivel assembly 96. A motorized swivel assembly 96 may include any combinations of a motor, appropriate gears, chains, supporting structure, etc., which together, constitute a base and a plate capable of rotation relative to the base.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

I claim:

1. A cable trolley comprising:

(a) a transport structure having a top end and a bottom end;

(b) a cable engagement device disposed on said top end;

(c) a swivel assembly disposed on said bottom end, said swivel assembly comprises a central axis of rotation, a support ring having an opening and a central axis of rotation, a sleeve having a first end and a second end, a retainer disposed on said first end and an adaptor disposed on said second end, wherein said second end of said sleeve is configured to be inserted through said opening until said retainer of said sleeve comes in contact with said support ring and said sleeve is co-axially rotatable relative to said support ring; and (d) a first gear having a central axis of rotation and a second gear operably coupled to said first gear, wherein said first gear is coaxially attached to said sleeve and said second gear is adapted to a motor.

2. The cable trolley of claim 1, further comprising a locking mechanism having a slot adapted to a portion of said retainer and a lock having an axis of rotation that is substantially perpendicular to said central axis of rotation of said swivel assembly, said lock attached to said support ring, wherein when said lock is disposed within said slot, rotation of said sleeve relative to said support ring is prevented and when said lock is removed from said slot, rotation of said sleeve relative to said support ring is allowed.

3. The cable trolley of claim 1, further comprising a carrier having a top end, a bottom end, said carrier is adapted to said adaptor at said top end of said carrier.

4. The cable trolley of claim 3, further comprising at least one handle bar fixedly attached to a portion of said transport structure, wherein said at least one handle bar serves as a grasp point for a user seated in said carrier to apply a torque to rotate said carrier about said central axis of rotation of said swivel assembly.

5. The cable trolley of claim 1, wherein said support ring further comprises a grease port adapted to receive application of grease between said sleeve and said support ring through said grease port.

6. The cable trolley of claim 1, further comprising a rotation mechanism capable of rotating said sleeve about said central axis of rotation of said swivel assembly.

7. The cable trolley of claim 1, further comprising a washer configured to be disposed between said retainer and said support ring.

8. The cable trolley of claim 1, further comprising a quick coupling link attached to said swivel assembly, said quick coupling link is configured to secure a user with zipline equipment.

9. The cable trolley of claim 8, wherein said quick-coupling link is a carabiner.

10. A cable trolley comprising:

(a) a transport structure having a top end and a bottom end;

(b) a cable engagement device disposed on said top end;

(c) a swivel assembly disposed on said bottom end, said swivel assembly comprises a central axis of rotation, a support ring having an opening and a central axis of rotation, a sleeve, a retainer disposed on a first end of said sleeve and an adaptor disposed on a second end of said sleeve, wherein said second end of said sleeve is configured to be inserted through said opening until said retainer of said sleeve comes in contact with said support ring and said sleeve is co-axially rotatable relative to said support ring; and (d) a locking mechanism comprising a slot adapted to a portion of said retainer and a lock having an axis of rotation that is substantially perpendicular to said central axis of rotation of said swivel assembly, said lock attached to said support ring, wherein when said lock is disposed within said slot, rotation of said sleeve relative to said support ring is prevented and when said lock is removed from said slot, rotation of said sleeve relative to said support ring is allowed.

11. The cable trolley of claim 10, further comprising a quick coupling link attached to said swivel assembly, said quick coupling link is configured to secure a user with zipline equipment.

12. The cable trolley of claim 11, wherein said quick-coupling link is a carabiner.

13. The cable trolley of claim 10, wherein said support ring further comprises a grease port adapted to receive application of grease between said sleeve and said support ring through said grease port.

14. The cable trolley of claim 10, further comprising a rotation mechanism capable of rotating said sleeve about said central axis of rotation of said swivel assembly.

15. The cable trolley of claim 10, further comprising a washer configured to be disposed between said retainer and said support ring.

* * * * *